United States Patent [19]

Read

[11] Patent Number: 4,700,782

[45] Date of Patent: Oct. 20, 1987

[54] FLOW CONTROL VALVE FOR USE IN OIL AND GAS WELLS AND THE LIKE

[75] Inventor: Norman W. Read, Dallas, Tex.

[73] Assignee: Dresser Industries, Inc., Dallas, Tex.

[21] Appl. No.: 928,445

[22] Filed: Nov. 7, 1986

[51] Int. Cl.[4] ..... E21B 34/12

[52] U.S. Cl. ..... 166/330; 166/332

[58] Field of Search ..... 166/330, 331, 332

[56] References Cited

U.S. PATENT DOCUMENTS

| | | | |
|---|---|---|---|
| 3,386,701 | 6/1968 | Potts | 251/229 |
| 4,210,207 | 7/1980 | McStravick et al. | 166/330 |
| 4,270,606 | 6/1981 | McStravick et al. | 166/331 X |
| 4,293,038 | 10/1981 | Evans | 166/331 |
| 4,421,171 | 12/1983 | Haynes | 166/331 |
| 4,508,173 | 4/1985 | Read | 166/330 |

*Primary Examiner*—Stephen J. Novosad

[57] ABSTRACT

An improved flow control valve for oil and gas wells and the like that includes a simplified valve actuating member that converts rotation of the tubing string into reciprocal motion of the valve actuating member and into a pivotal movement of the valve between open and closed positions.

8 Claims, 7 Drawing Figures

FLOW CONTROL VALVE FOR USE IN OIL AND GAS WELLS AND THE LIKE

BACKGROUND OF THE INVENTION

This invention relates generally to an improved valve for use in oil and gas wells or the like. More specifically, but not by way of limitation, this invention relates to a flow control valve including a valve member that is caused to move between open and closed positions by rotation of the tubing.

In operation performed in oil and gas wells or the like, it is desirable to be able to provide as large a flow path through a tool situated in the well as possible while still maintaining the functional integrity of the tool. Valves, particularly ball valves, provide a relatively large flow path through the housing in which they are contained. Further, it is desirable to be able to provide, when the valve is closed, a fluid tight seal preventing flow through the tool. Again, ball valves are particularly adapted to such situations since the sealing structure is annular in configuration and is relatively simple to construct.

A relatively large number of U.S. patents have issued providing various apparatus for utilizing valves of the ball valve type in tools lowered into oil and gas wells. One such patent is U.S. Pat. No. 4,508,173 that illustrates a flow control valve of the ball type for use in oil and gas wells that is actuated by rotation of the tubing and that will hold pressure therethrough regardless of whether the pressure differential exists across the valve from above to below or from below to above. The ball valve illustrated in this patent is actuated by a force couple that is generated by a pair of reciprocating actuating members which are caused to move in opposite directions during the pivoting of the ball valve from one position to the other. While such structure operates very effectively, such a valve is relatively expensive and complex to construct.

It is therefore one object of this invention to provide an improved flow control valve of the ball type that is arranged to be lowered into a well bore and that is moved between open and closed positions by rotation of the well tubing through a simplified actuating mechanism that is relatively simple and inexpensive to manufacture.

SUMMARY OF THE INVENTION

This invention then provides an improved flow control valve for use in oil and gas wells and the like. The valve comprises an elongated, cylindrical valve body member; a first tubular connector member rotatably disposed within a first end of the body member and having one end arranged for connection to a first tubular member; and a second tubular connector member disposed in and connected to a second end of the body member and having a first end arranged for connection with a second tubular member and a second end forming an annular valve seat. A ball valve member is located in the valve body member adjacent to the seat and pivotal therein between open and closed positions. A valve actuator is provided for pivoting the ball valve member that includes a valve actuator member that reciprocates in said cylindrical valve body member. The valve actuator member includes a gudgeon that engages the first connector member for changing rotational movement of the first tubular connector member to reciprocal movement of the valve actuator member and includes an actuator pin that engages the valve member for changing the reciprocal movement of the valve actuator member into pivotal movement of the valve member.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1:
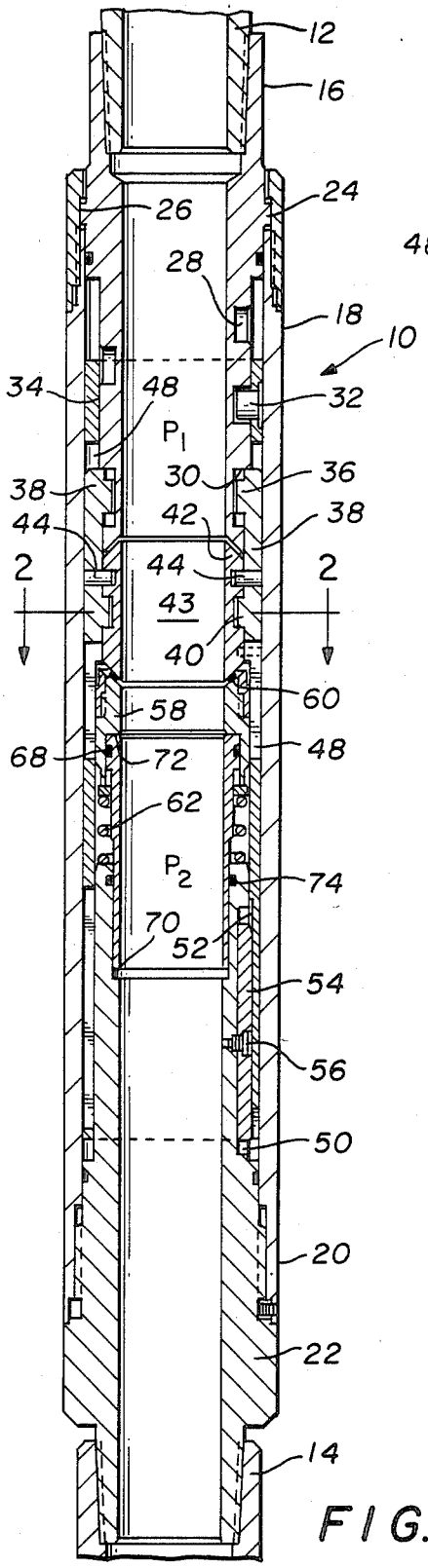
FIG. 1 is a cross-sectional view of a flow control valve that is constructed in accordance with the invention.
Figure 2:
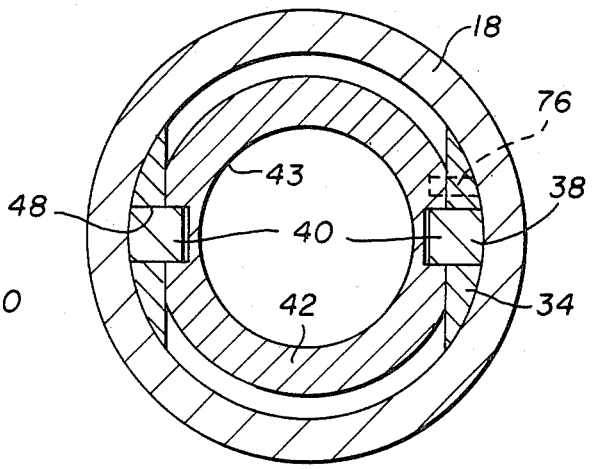
FIG. 2 is a transverse cross-sectional view of the valve of FIG. 1 taken generally along the line 2—2 of FIG. 1.
Figure 3:
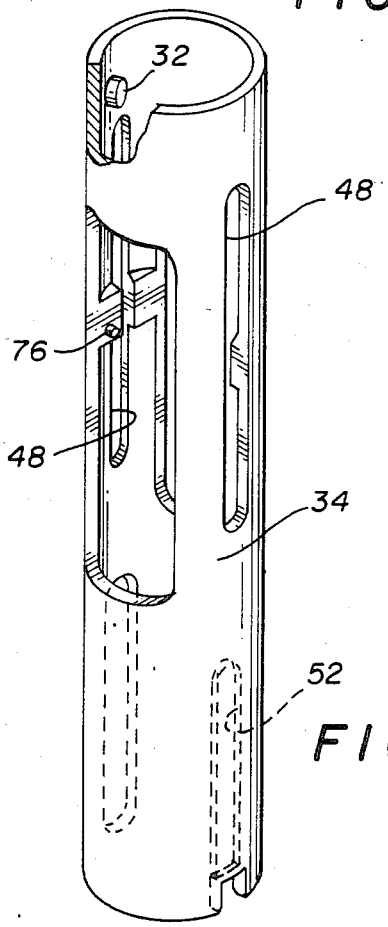
FIG. 3 is an enlarged, pictoral view of a valve actuator member that is utilized in the flow control valve of FIG. 1.

Referring to the drawing and to FIG. 1 in particular, shown therein and generally designated by the reference character 10 is a flow control valve assembly that is costructed in accordance with the invention. The flow control valve assembly 10 is illustrated as being connected at its uppermost end to a tubing or tubular member 12 upon which the flow control valve assembly is extended into the well bore (not shown) and at its lower end to a second tubular member or tubing 14 to which additional well tools (not shown) may be attached. Such tools will generally include a packer or anchor having drag members that resist rotation.

The valve assembly 10 is connected to the tubing 12 by a tubular, first or upper connector member 16 which is partially disposed in an elongated, tubular body member 18. The lower of the body member 18 is end connected by threads 20 to a tubular, second or lower connector member 22. The connector member 16 is rotatably connected to the body member 18 by a radially extending flange 24 on the member 16 which is disposed in an annular groove 26 located in the upper end of the body member 18.

On its exterior, the upper connector member 16 is provided with a helical groove 28 and with an annular groove 30 near its lower end. The helical groove 28 is sized and arranged to receive a gudgeon 32 carried by a valve actuating member 34 which is disposed for reciprocal movement between the body member 18 and the upper connector member 16. As arranged, rotation of the upper connector member 16 causes the gudgeon 32 to traverse the helical groove 28 and, depending upon the direction of rotation of the member 16, causes the actuator member 34 to move either upwardly or downwardly with respect to the connector member 16 and the body member 18.

The annular groove 30 is sized to receive lugs 36 that project inwardly from a pair of valve support members 38. Each of valve support members 38 also has a valve member pivot lug 40 located near the lower ends thereof that is located to pivotally support a generally spherical valve member 42. A bore 43 extends through the valve member 42.

Each support member 38 also carries a stop pin 44 that is disposed in a corresponding arcuate groove 46 (see FIGS. 5, 6 and 7) formed in the exterior of the valve member 42. The stop pins 44 limit the extent of pivotal movement of the valve member 42.

The support members 38 are located in slots 48 that are formed in the valve actuator member 34. The slots 48 are substantially longer than the valve support members 38 so that the valve actuator member 34 can move longitudinally with respect to the support members 38.

To prevent relative rotation between the valve actuating member 34 and the valve body member 18, mating keyslots 50 and 52 are formed in the lower connector member 22 and in the body member 18. An elongated key 54 is located in the mating keyslots and attached to the lower connector member 22 by a threaded fastener 56. With this arrangement, the upper connector member 16 can be rotated relative to the body member 18, relative to the valve member 42 and actuator member 34 to cause the reciprocating movement of the valve actuator member 34.

The upper end of the lower connector member 22, which is disposed within the body member 18, is arranged to provide valve seat means for engagement with the valve member 42. It is the engagement between the seat and the valve member 42 that prevents the flow of fluid through the flow control valve assembly 10. The seat means includes a valve seat 58 which carries a resilient annular seal member 60 that is arranged to sealingly engage the surface of the valve member 42. The valve seat 58 is movable axially within the valve actuator member 34 in response to the urging of a compression spring 62 that continually biases the seat toward engagement with the valve member 42.

Forming part of the seat means and slidingly disposed in the bore of the seat 58 is an annular balance piston 66 which has an O-ring or resilient annular seal member 68 that forms a sliding seal with the seat 58. The balance piston 66 is free to travel axially within the valve assembly 10 between an upwardly facing shoulder 70 on the interior of the lower connector 22 and a downwardly facing shoulder 72 formed in the seat 58. The balance piston 66 is also in sliding and sealing engagement with an O-ring seal 74 that is carried by the lower connector 22.

Figure 5:
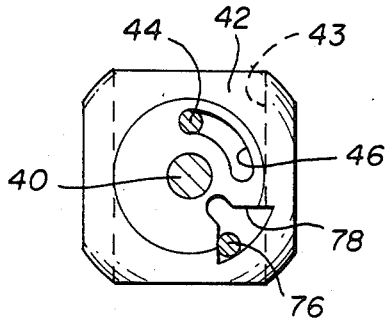
FIGS. 5, 6 and 7 are side views of a valve member removed from the valve of FIG. 1 and illustrated in various operating positions thereof.
Figure 6:
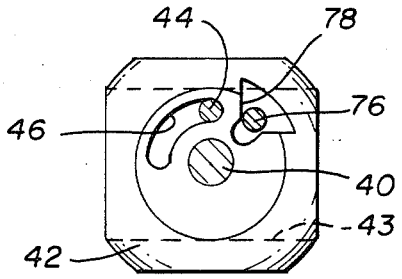
Figure 7:
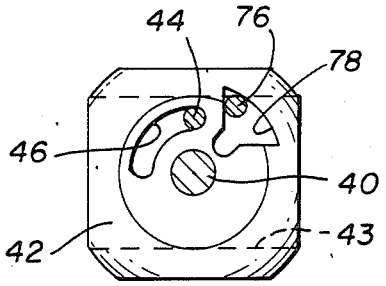

The valve actuator member 34, which is constructed from a single piece of tubing, also carries an actuating pin 76 which projects interiorly thereof into a fan shaped recess 78 that is formed on the exterior of the valve member 42. As shown in FIGS. 5, 6 and 7, the fan shaped recess 78 is substantially larger than the pin 76. Thus, there is a provision for lost motion, that is, the pin 76 can move for some distance prior to pivoting the valve member 42 due to the travel required for engagement of the pin 76 with the opposite side of the recesse 78.

It should also be pointed out that the valve assembly 10 will hold against a pressure P1 located below the valve member 42 or against a pressure P2 in the interior of the valve assembly 10 above the valve member 42. Consider first a pressure differential from below the valve member 42 to above so that the upward force on the valve seat 58 as a result of the pressure P1 will be upwardly, that is, in a direction to move the valve seat 58 into tighter sealing engagement with the valve member 42. This results from the construction of the areas defined by the seals 60, 68 and 74. For example, with the pressure greater below, that is where P1 is greater, an upward force is generated by the area between the seal 74 and the bore extending through the seat 58. The downward force resulting from the P1 pressure is generated by the area between the seal 60 and the bore of the seat 58. The areas are designed so that the first mentioned area is greater, and thus the resultant force is upwardly on the seat 58. It should also be noted that the spring 62 exerts a constant force upwardly on the valve seat 58.

Forces generated by pressure differential from above to below, that is, by pressure P2, also exert an upwardly directed resultant force on the seat 58. This occurs because the pressure bleeds around the valve member 42 causing a downward force to be exerted on the valve seat 58 as defined by the area between the seals 68 and 60 while an upward force is developed on the valve seat 58 as a result of the pressure acting on the area defined by the seals 68 and 74. Since the area defined by the seals 68 and 74 is larger than the area defined by the seals 68 and 60, the net or resultant force will be in the upward direction. It should also be pointed out again that the spring 62 aids in maintaining the valve seat 58 in sealing engagement with the valve member 42.

OPERATION OF THE VALVE ASSEMBLY 10

Mechanically, the valve assembly 10 operates as described hereinafter. The valve assembly 10 will be assembled with the tubing 12 and perhaps with a packer or the like which will be attached to the tubing 14. The packer will have drag springs or some form of device to prevent rotation of the tubing 14 and the lower connector member 22. The valve assembly 10 is thus lowered into a well bore (not shown) until it is located at the desired position therein. During lowering of the valve assembly 10 into the well bore, it will be run in in the condition shown in FIG. 1, that is, with the valve bore 43 aligned with the bore through the tool and the tubing 12 and 14.

Figure 4:
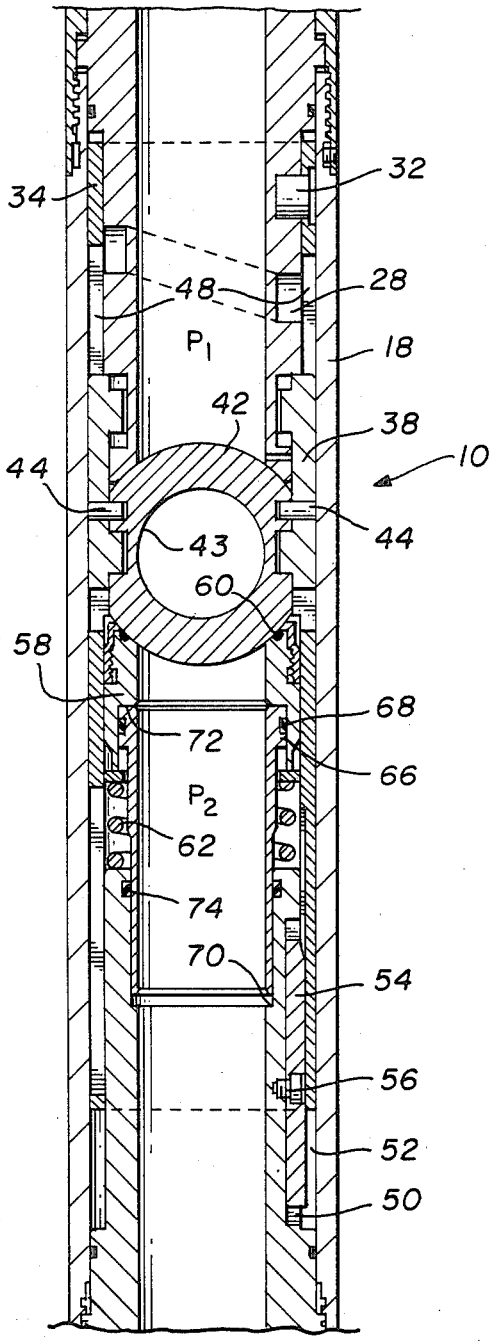
FIG. 4 is a cross-sectional view, somewhat enlarged, of the valve of FIG. 1, but illustrating the valve in a different operating position.

After reaching the desired location, the tubing 12 is rotated in a direction to cause the gudgeon 32 to traverse the helical groove 28 which converts the rotational movement of the upper connector member 16 into longitudinal or axial movement of the valve actuator member 34. As the valve actuator member 34 moves upwardly, the actuator pin 76 moves from the position illustrated in FIG. 5 into the smaller neck portion of the recess 78 causing the valve member 42 to pivot into the position illustrated in FIG. 6. Continued upward movement of the valve actuator member 34 carries the pin 76 upwardly until it is in the position illustrated in FIG. 7. As illustrated in FIG. 7, the valve member 42 is in the closed position which corresponds to the position illustrated in FIG. 4.

To return the valve to the open position from the closed position, rotation of the tubing in the opposite direction is made, causing the gudgeon 32 to traverse downwardly in the helical groove 28, moving the valve actuating member 34 relatively downwardly. Initial downward movement thereof moves the pin 76 from the position illustrated in FIG. 7 to the position illustrated in FIG. 6. It will be noted that at this time the valve member 42 has not changed positions. Continued downward movement of the valve actuator member 34 through rotation of the tubing 12 causes the valve actuator pin 76 to move to the position illustrated in FIG. 5, at which time the bore 43 is again in alignment with the axial alignment of the tool and the valve is in the open position.

From the foregoing detailed description, it can be seen that the valve assembly described in detail herein is one that has a valve member that is actuated by rotation of the tubing. The valve assembly will hold pressure from either direction and the apparatus for causing the pivotal movement of the valve member is relatively simple. The valve member is pivoted by translating rotational motion of the tubing into reciprocating motion of the valve actuating member and converting such reciprocating motion into a pivoting motion of the valve member.

The foregoing detailed description has been presented by way of example only and it will be understood that many changes and modifications can be made thereto without departing from the spirit or scope of the invention.

What is claimed is:

1. An improved flow control valve assembly for use in oil and gas wells and the like comprising:

an elongated, cylindrical valve body member;

a first tubular connector member rotatably disposed within a first end of said body member and having one end arranged for connection to a first tubular member;

a second tubular connector member disposed in and connected to a second end of said body member and having a first end arranged for connection with a second tubular member and a second end forming an annular valve seat;

a ball valve member located in said valve body member adjacent to said seat and pivotal therein between a closed position preventing and an open position permitting flow through said first and second tubular connector members and valve body member;

valve actuator means including a valve actuator member located for reciprocal movement between said valve body member, valve member, and first and second tubular connector members, said valve actuator member having an actuator pin and an actuator gudgeon located thereon, said gudgeon engaging said first tubular connector member for changing rotational movement of said first tubular connector member to reciprocal movement of said valve actuator member and pin and said actuator pin engaging said valve member for changing the reciprocal movement of said pin into pivotal movement of said valve member whereby said valve member pivots between said open and closed positions.

2. The valve assembly of claim 1 wherein said first tubular connector member has:

a helical groove in the exterior thereof for receiving said gudgeon; and, a radially-projecting flange on the exterior thereof located in an annular groove in said valve body member for permitting rotation of said first tubular connector member relative to said body member and preventing relative longitudinal movement therebetween.

3. The valve assembly of claim 1 and also including valve member pivot means having:

pivot lug portions pivotally supporting said valve member;

stop pins engaging said valve member to limit pivotal movement thereof relative to said pivot means; and, inwardly projecting swivel flanges located in an annular groove in said first connector member whereby said first connector member swivels relative to said pivot means and valve member while preventing relative longitudinal movement therebetween.

4. The valve assembly of claim 2 and also including valve member pivot means having:

pivot lug portions pivotally supporting said valve member;

stop pins engaging said valve member to limit pivotal movement thereof relative to said pivot means; and, inwardly projecting swivel flanges located in an annular groove in said first connector member whereby said first connector member swivels relative to said pivot means and valve member while preventing relative longitudinal movement therebetween.

5. The valve assembly of claim 4 and also including means preventing rotational movement between said second tubular connector member and said valve actuator member.

6. The valve assembly of claim 5 wherein said means for preventing rotational movement includes:

longitudinally extending aligned slots in said second tubular connector and said valve actuator member; and, a key member disposed in said aligned slots preventing rotation and permitting relative longitudinal movement therebetween.

7. The valve assembly of claim 6 wherein the second end of said second tubular connector member includes:

a valve seat portion engageable with said valve member; and, resilient means biasing said valve seat portion toward said ball valve member.

8. The valve assembly of claim 7 and also including seal means carried by said second tubular connector member for biasing said valve seat toward said valve member in response to fluid pressure in said valve assembly on either side of said valve member.

* * * * *